US011759802B2

(12) United States Patent
Chiu

(10) Patent No.: US 11,759,802 B2
(45) Date of Patent: Sep. 19, 2023

(54) GARDEN SPRINKLER

(71) Applicant: Shih-Wei Chiu, Lu Kang (TW)

(72) Inventor: Shih-Wei Chiu, Lu Kang (TW)

( * ) Notice: Subject to any disclaimer, the term of this patent is extended or adjusted under 35 U.S.C. 154(b) by 108 days.

(21) Appl. No.: 17/403,770

(22) Filed: Aug. 16, 2021

(65) Prior Publication Data

US 2023/0047279 A1 Feb. 16, 2023

(51) Int. Cl.
*B05B 3/06* (2006.01)
*B05B 3/04* (2006.01)

(52) U.S. Cl.
CPC ..... *B05B 3/063* (2013.01); *B05B 3/0472* (2013.01); *B05B 3/0486* (2013.01)

(58) Field of Classification Search
CPC ..... B05B 3/063; B05B 3/0472; B05B 3/0481; B05B 3/0486
See application file for complete search history.

(56) References Cited

U.S. PATENT DOCUMENTS 2,758,874 A * 8/1956 Snyder ..... B05B 3/00 239/229
2,778,681 A * 1/1957 Dudley ..... B05B 3/0472 239/230
2,904,261 A * 9/1959 Johnson ..... B05B 3/021 239/230
2,928,608 A * 3/1960 Royer ..... B05B 3/0481 239/230
3,669,356 A * 6/1972 Senninger ..... B05B 3/0472 239/233
3,764,073 A * 10/1973 Costa ..... B05B 3/0472 239/233
3,779,462 A * 12/1973 Bruninga ..... B05B 3/0472 239/230
3,799,631 A * 3/1974 Martina ..... F16C 33/74 239/230
3,957,205 A * 5/1976 Costa ..... B05B 3/026 239/230
4,173,306 A * 11/1979 Ridgway ..... B05B 3/0477 239/230
4,234,126 A * 11/1980 Morgan ..... B05B 3/0472 239/230
4,295,610 A * 10/1981 Clements ..... B05B 3/0472 239/230
4,333,610 A * 6/1982 Clements ..... B05B 3/0472 239/601
4,462,545 A * 7/1984 Lourenco ..... B05B 1/28 239/97
4,566,633 A * 1/1986 Rinkewich ..... B05B 3/0422 239/237
4,580,724 A * 4/1986 Brown ..... B05B 3/0472 239/233

(Continued)

*Primary Examiner* — Joseph A Greenlund

(57) ABSTRACT

A garden sprinkler has an input base, an output member rotatably installed at the top of the input base, and a rotating member capable of driving the output member. The output Both sides of the output member are respectively equipped with a first outlet and a second outlet. The first outlet is equipped with a first sprinkler, and the second outlet is equipped with a second sprinkler and an adjusting sleeve. The second sprinkler is a side outlet and is screwed with the adjusting sleeve. The second sprinkler can be adjusted by the adjusting sleeve, which improves the convenience of sprinkling operation without multiple sprinkler heads.

4 Claims, 8 Drawing Sheets

(56) References Cited

U.S. PATENT DOCUMENTS

| | | | | | |
|---|---|---|---|---|---|
| 5,052,620 | A * | 10/1991 | Rinkewich | B05B 3/0472 | 239/230 |
| 5,370,311 | A * | 12/1994 | Chen | B05B 3/063 | 239/233 |
| 6,079,637 | A * | 6/2000 | Ohayon | B05B 3/021 | 239/DIG. 1 |
| 6,494,385 | B1 * | 12/2002 | Chen | B05B 3/0472 | 239/233 |
| 6,758,413 | B1 * | 7/2004 | Chen | B05B 1/308 | 239/443 |
| 9,682,386 | B2 * | 6/2017 | Mareli | B05B 3/0481 | |
| 10,232,388 | B2 * | 3/2019 | Glezerman | B05B 3/0486 | |
| 11,471,899 | B1 * | 10/2022 | Debro | B05B 3/063 | |
| 2011/0132997 | A1 * | 6/2011 | Gal | A01G 25/00 | 239/214 |
| 2012/0318889 | A1 * | 12/2012 | Gorny | B05B 15/14 | 239/222.17 |
| 2019/0015851 | A1 * | 1/2019 | Ghosh | B05B 3/0472 | |
| 2023/0047279 | A1 * | 2/2023 | Chiu | B05B 3/063 | |

* cited by examiner

GARDEN SPRINKLER

BACKGROUND OF INVENTION

Field of Invention

The present invention relates to a garden sprinkler, and more particularly to an adjustable garden sprinkler.

Description of the Related Art

Sprinklers are very common devices for horticultural irrigation work. Usually, its structure includes a water inlet, a water outlet, and an angle rotation control member. The angle rotation control member swings to make all angles evenly sprinkled. However, the water flow enters the sprinkler from the water inlet, and then the water is sent out from the sprinkler outlet. There is only a single mode of sprinkling. The amount of water sprayed and its mode cannot be adjusted which can cause wasting water. In order to adjust the flow rate of the sprinkler, it needs to be replaced by another sprinkler with a different outlet.

Therefore, it is desirable to provide a garden sprinkler to mitigate and/or obviate the aforementioned problems.

SUMMARY OF THE INVENTION

An objective of present invention is to provide an adjustable garden sprinkler.

To achieve these and other objects of the present invention, a garden sprinkler has an input base, an output member rotatably installed at the top of the input base, and a rotating member capable of driving the output member. The output Both sides of the output member are respectively equipped with a first outlet and a second outlet. The first outlet is equipped with a first sprinkler, and the second outlet is equipped with a second sprinkler and an adjusting sleeve. The second sprinkler is a side outlet and is screwed with the adjusting sleeve. The second sprinkler can be adjusted by the adjusting sleeve, which improves the convenience of sprinkling operation without multiple sprinkler heads. Other objects, advantages, and novel features of invention will become more apparent from the following detailed description when taken in conjunction with the accompanying drawings.

DETAILED DESCRIPTION OF THE PREFERRED EMBODIMENT

Figure 1:
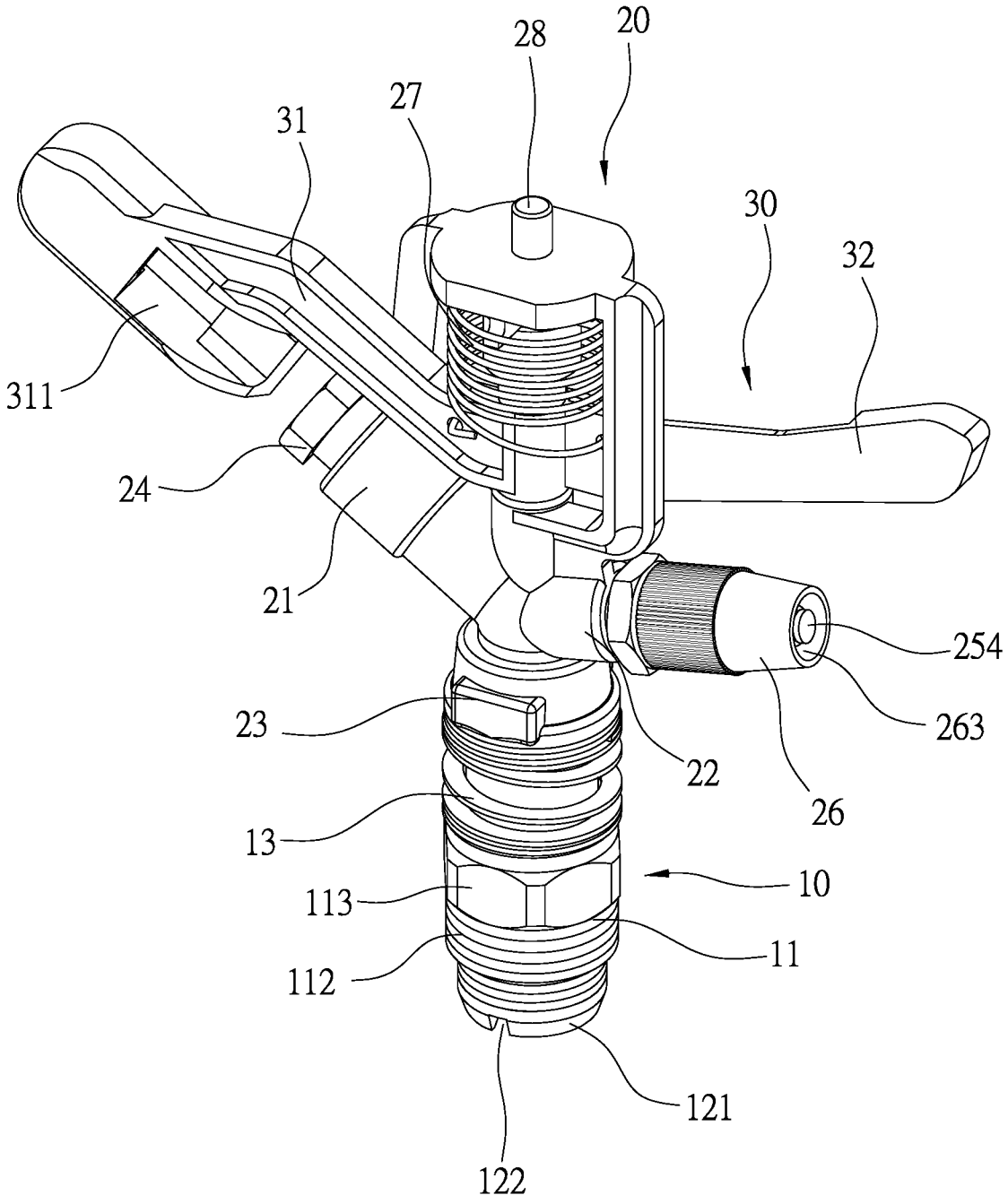
FIG. 1 is a three-dimensional view of a preferred embodiment according to the present invention.
Figure 2:
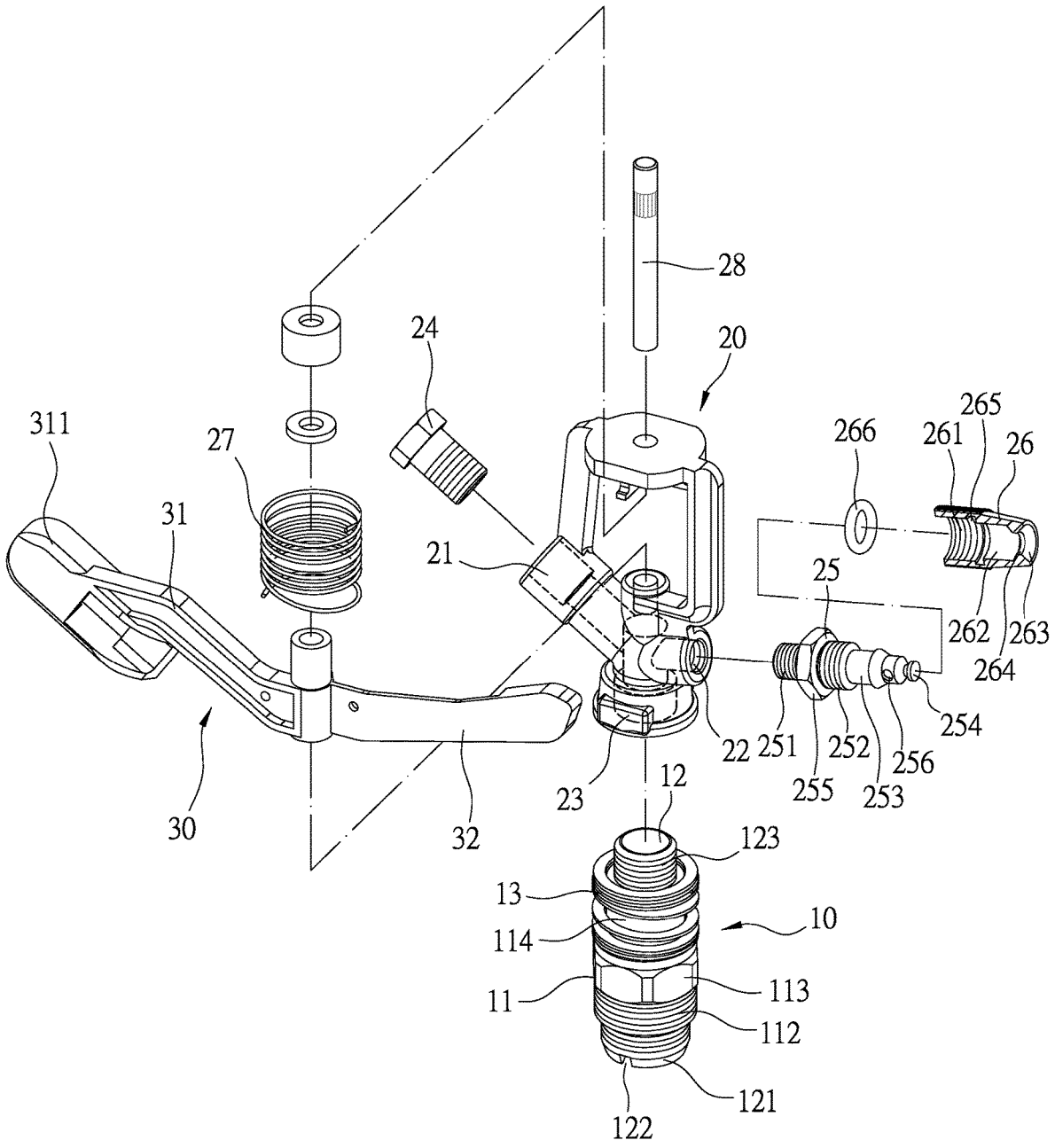
FIG. 2 is an exploded view of the preferred embodiment according to the present invention.
Figure 3:
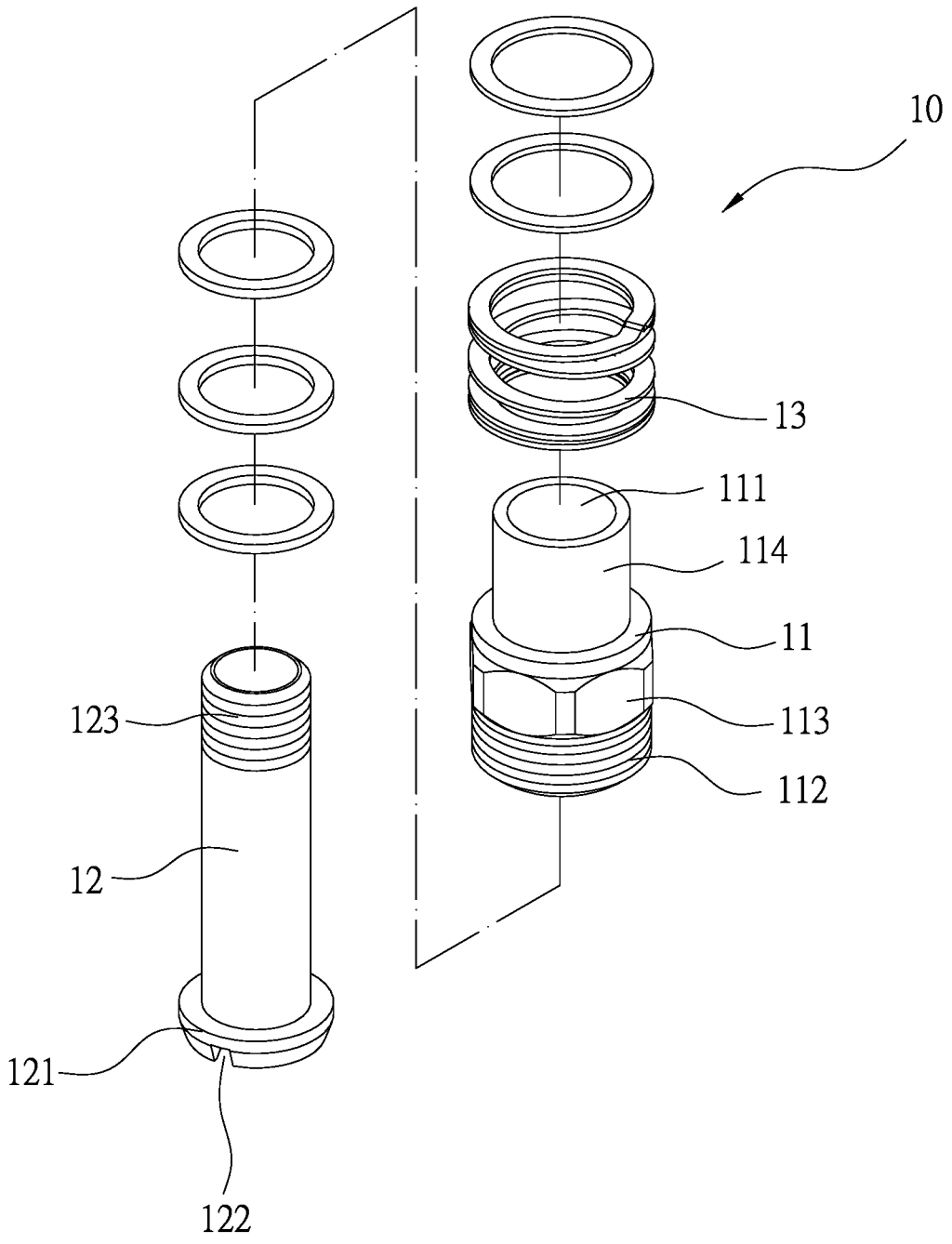
FIG. 3 is an exploded view of the input base of the preferred embodiment according to the present invention.

First, please refer to FIGS. 1, 2 and 3. A garden sprinkler comprises: an input base 10, an output member 20 and a rotating member 30. The input base 10 comprises a base tube 11, an axial tube 12, and an elastic member 13. The base tube 11 respectively has a central axial aperture 111 at top end and a lower end, and a threaded section 112, a non-column shaped engaging section 113 and an inserting section 114 with a smaller diameter sequentially arranged from bottom to top. The axial tube 12 is capable of being inserted into the central axial aperture 111 of the base tube 11 from a bottom side and has a protruding lip 121 with a groove 122 at a bottom end pushing against the bottom side of the base tube 11. Furthermore, the protruding lip 121 has a connecting portion 123 with an outer threaded portion protruding from the inserting section 114 at a top end of the axial tube 12. Two sides of the output member 20 respectively have a first outlet 21 and a second outlet 22, and the first and second outlet apertures 21, 22 are connected with each other and pass through an assembling portion 23 with an inner threaded section disposed at a bottom of the output member 20. Moreover, the first outlet 21 comprises a first sprinkler 24, the second outlet 22 comprises a second sprinkler 25 and an adjusting sleeve 26. The second sprinkler 25 has an attaching portion 251 with an outer threaded portion, and the attaching portion 251 is mounted at the second outlet 22. The second sprinkler 25 further has a larger section 252, a smaller section 253 and an adjusting end 254, and a screw portion 255 is disposed between the attaching portion 251 and the larger section 252. The screw portion 255 has a polygonal shape. The larger section 252 has an outer threaded portion, the smaller section 253 has an outlet aperture 256 on a side, and the adjusting end 254 has a T-shaped cross-section and protruding from a front end of the smaller section 253. The adjusting sleeve 26 has an assembling portion 261 with an inner threaded section engaging with the larger section 252, and an inner diameter of the adjusting sleeve 26 is larger than the smaller section 253 to define a collecting space 262. A diverging spout 263 is disposed at a front end of the adjusting sleeve 26, and the diverging spout 263 and the collecting space 262 are connected by an exporting opening 264. The exporting opening 264 has having an inner diameter larger than an outer diameter of the adjusting end 254. A ring groove 265 is disposed between the assembling portion 261 and the collecting space 262, and the ring groove 265 is provided with an O ring 266 pushing against the smaller section 253 of the second sprinkler 25. The output member 20 and the rotating member 30 are respectively connected to a scroll spring 27, the rotating member 30 is positioned by a shaft bolt 28, the rotating member 30 has a first swinging arm 31 and a second swinging arm 32, and the scroll spring 27 aligns the first and second swinging arm 31, 32 with the first and second outlets 21, 22. Furthermore, the first swinging arm has a pushing portion 311 facing the first sprinkler 24.

For the assembly, please refer to FIGS. 1-4 again. The assembling portion 23 of the output member 20 is screwed onto the connecting portion 123 of the axial tube 12, and the assembling portion 23 abuts the elastic member 13 to maintain a gap from the base tube 11. With rotation of the axial tube 12 and the base tube 11, the output member 20 can rotate with the axial tube 12, and the output member 20 is rotatably assembled on the top of the input base 10. The first and second outlets 21, 22 of the output member 20 are respectively installed on the first and second sprinklers 24, 25. Furthermore, the second sprinkler 25 is employed with the adjusting sleeve 26, through the rotation of the adjusting sleeve 26 to adjust the relative positions among the diverging spout 263, the exporting opening 264 and the adjusting end 254 and to control the water output mode of the second sprinkler 25. The output member 20 is equipped with a scroll spring 27 to be installed on the rotating member 30, and the shaft bolt 28 is configured to secure the combination such that the rotating member 30 is capable of rotating around the shaft bolt 28 to push the output member 20 for rotation.

Figure 4:
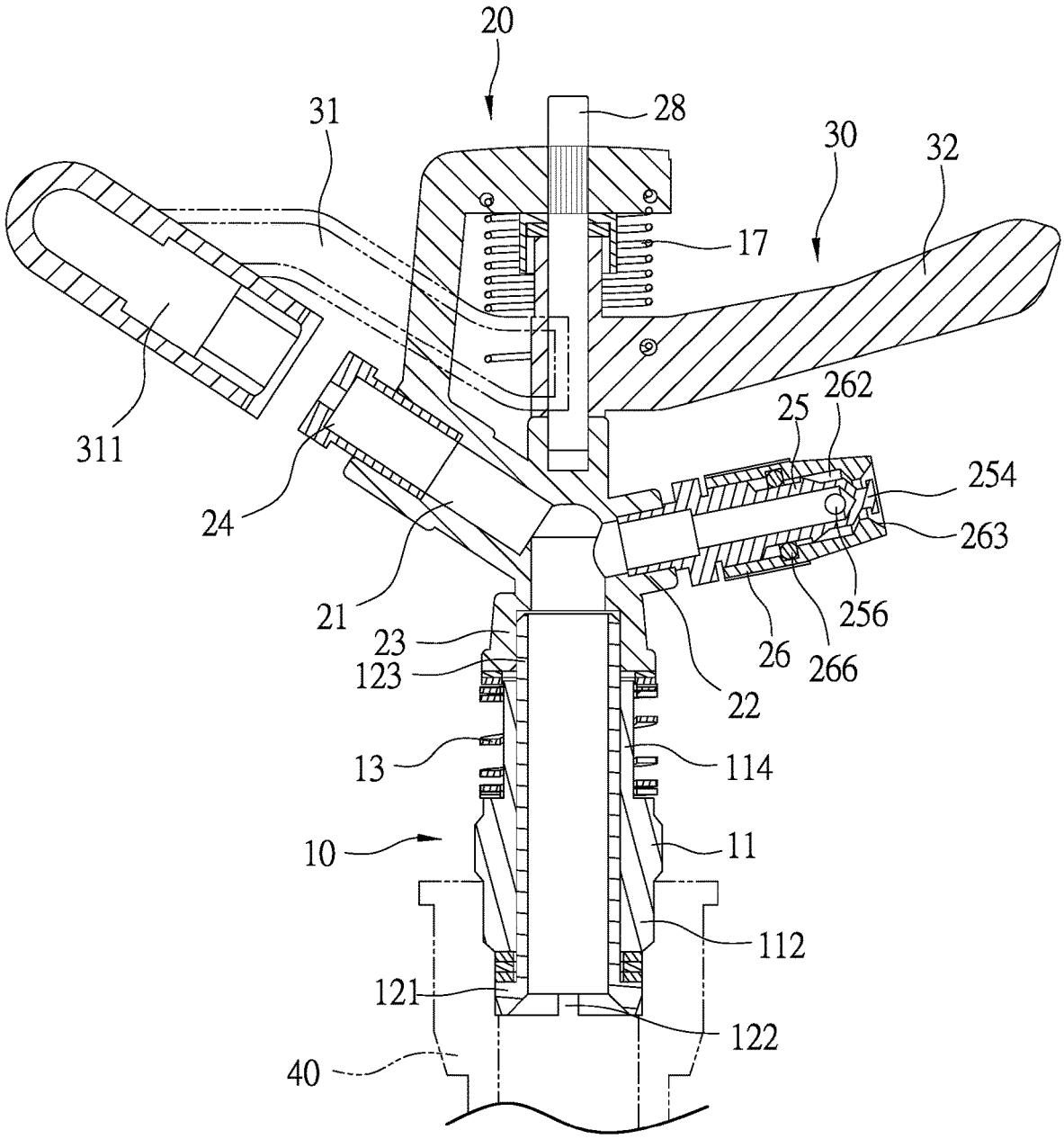
FIG. 4 is a combined cross-sectional view of the preferred embodiment according to the present invention.
Figure 5:
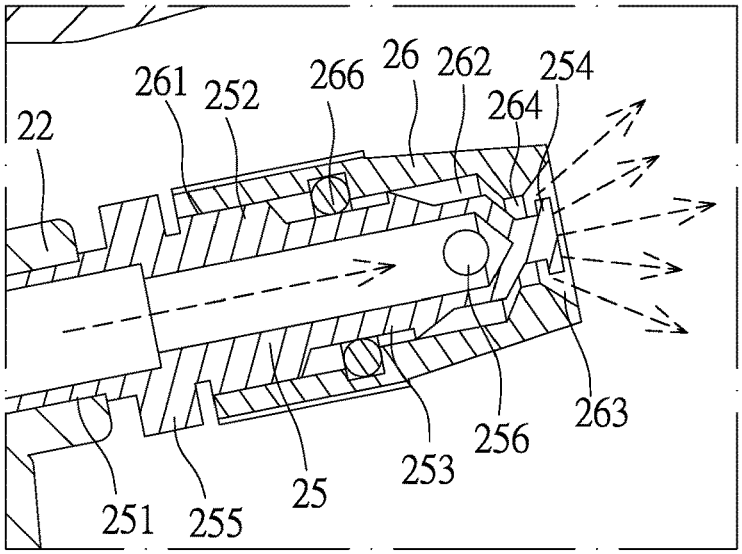
FIG. 5 is a local cross-sectional view of the second sprinkler in a spray state as the preferred embodiment according to the present invention.
Figure 6:
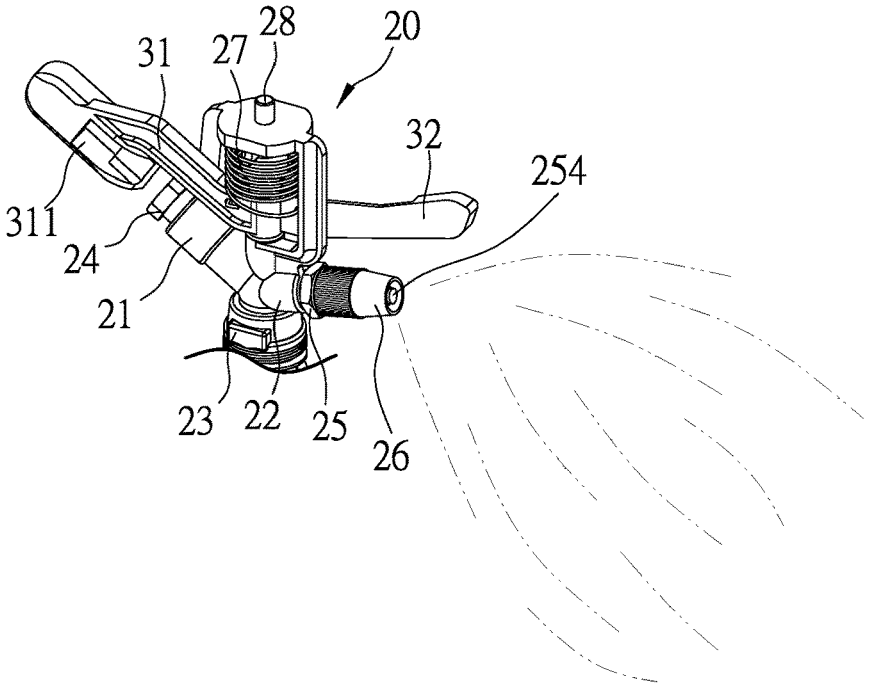
FIG. 6 is a schematic diagram showing the second sprinkler forming spray as the preferred embodiment according to the present invention.

For actual use, please refer to FIGS. 1 and 4. The sprinkler is installed on a bracket 40 with the input base 10, and is connected to a water source to divert water to the first and second outlets 21, 22 of the output member 20 through the axial tube 12, and then sprays water from the first and second sprinkler heads 24, 25. As shown in FIGS. 5 and 6, the adjusting end 254 of the second sprinkler 25 passes through the exporting opening 264 and is disposed in the diverging spout 263. Meanwhile, when the water flows from the outlet aperture 265 into the collecting space 262 and injects from the front of the adjusting sleeve 26, due to the end of the adjusting end 254 is larger than the exporting opening 264, which allows a larger amount of water flow to pass through and spray out from the diverging spout 263 to form a large range but relatively close spray performance. The range and density of the spray performance can be changed by the fine adjustment of the adjusting sleeve 26.

Figure 7:
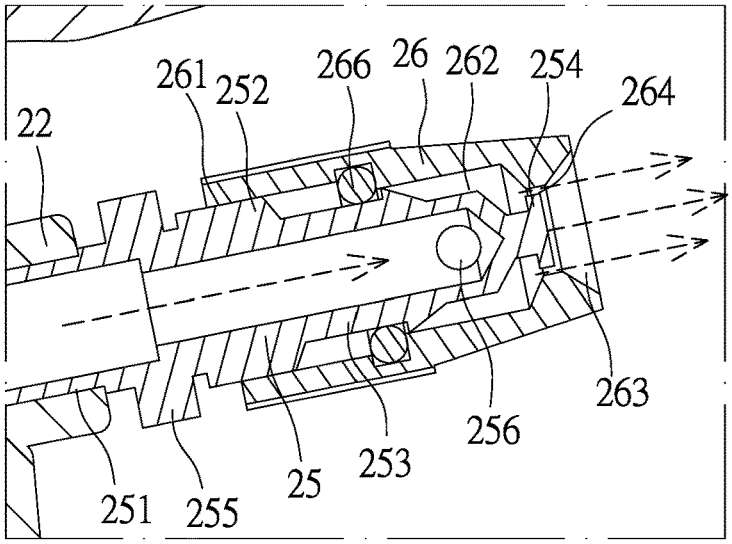
FIG. 7 is a local cross-sectional view of the second sprinkler forming a water column as the preferred embodiment according to the present invention.
Figure 8:
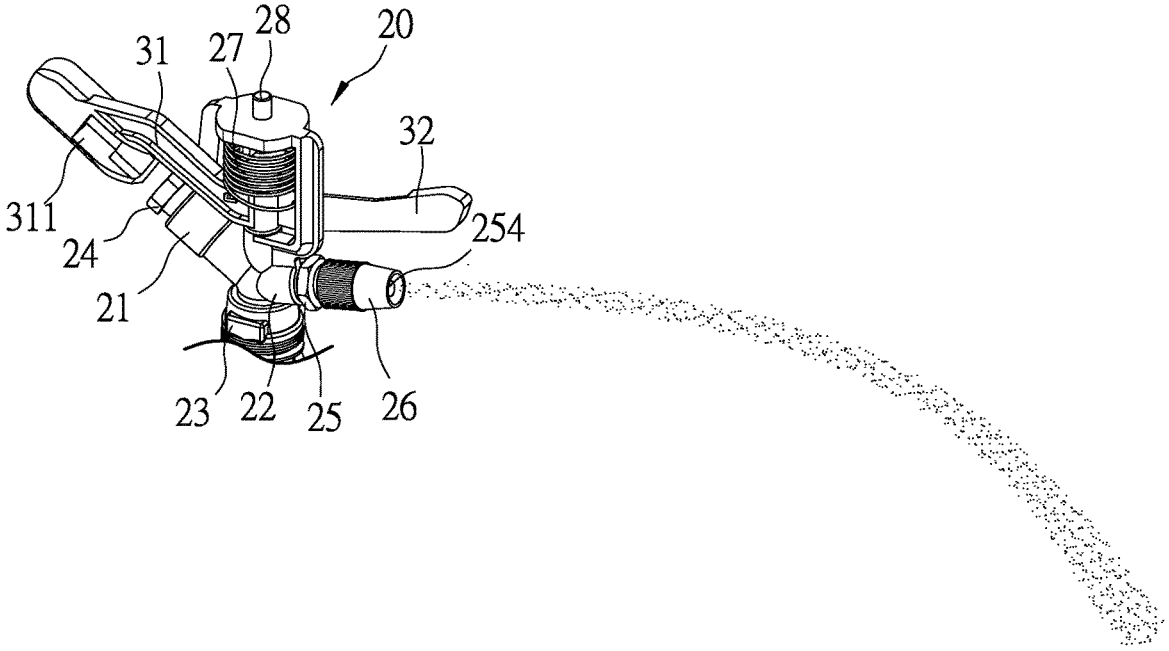
FIG. 8 is a schematic diagram showing the second sprinkler forming a water column as the preferred embodiment according to the present invention.

Secondly, when the adjusting sleeve 26 is rotated toward outside, as shown in FIGS. 7 and 8, the exporting opening 264 is blocked by the adjusting end 254, the space allowing the water flow to pass is reduced, so that the water flow can only be squeezed out from the gap between the exporting opening 264 and the adjusting end 254. Therefore, the enhanced spraying intensity of the water stream forms a water column with a smaller spraying range but a longer distance by adjusting the adjusting sleeve 26.

Figure 9:
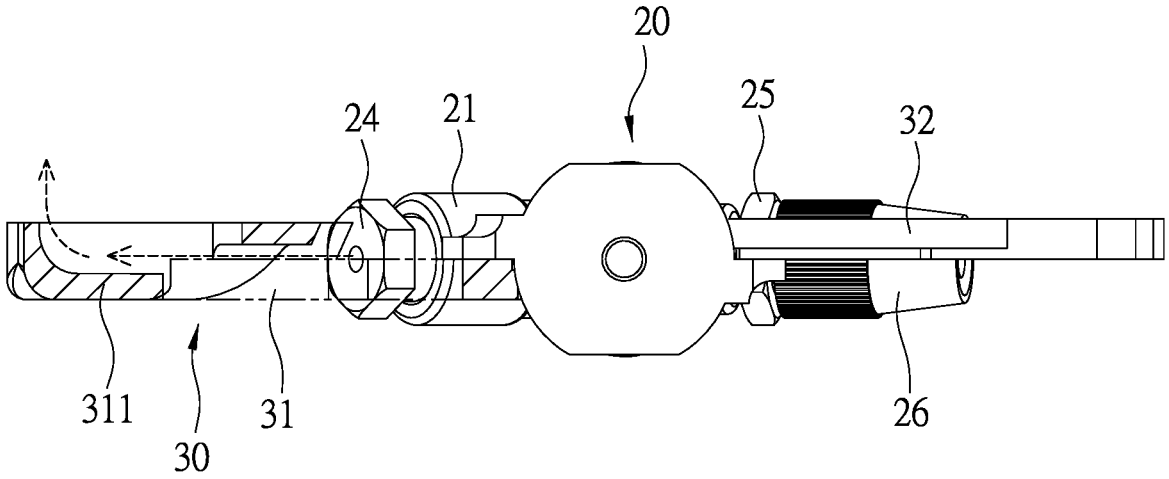
FIG. 9 is a top view of the preferred embodiment according to the present invention without sprinkling.
Figure 10:
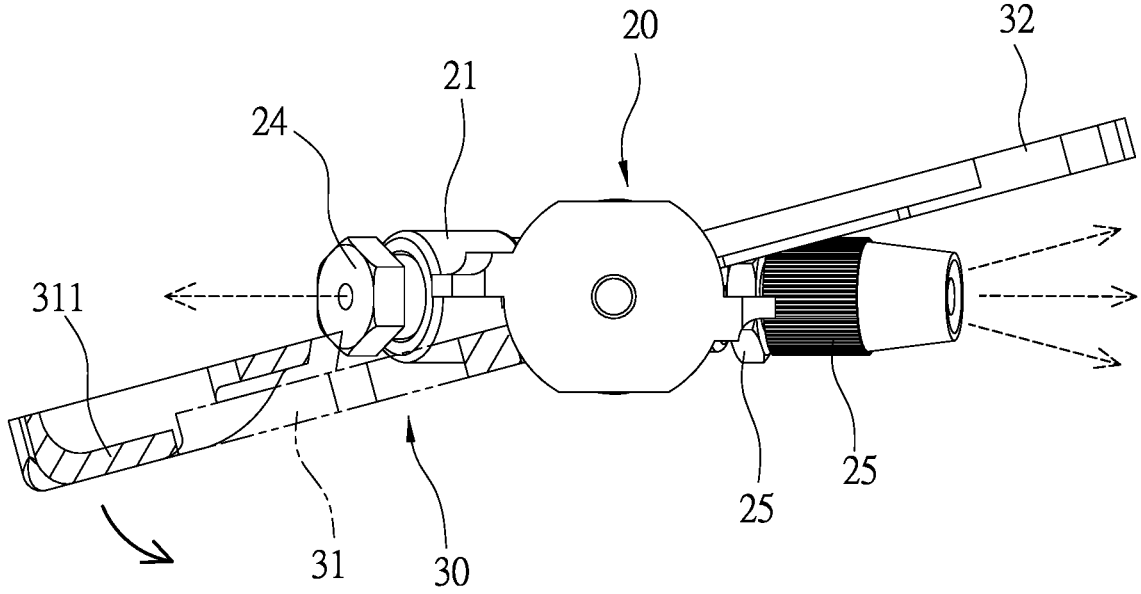
FIG. 10 is a schematic diagram showing the first sprinkler spraying water against the first swing arm and causing the rotating member to swing during the sprinkling operation of the preferred embodiment according to the present invention.
Figure 11:
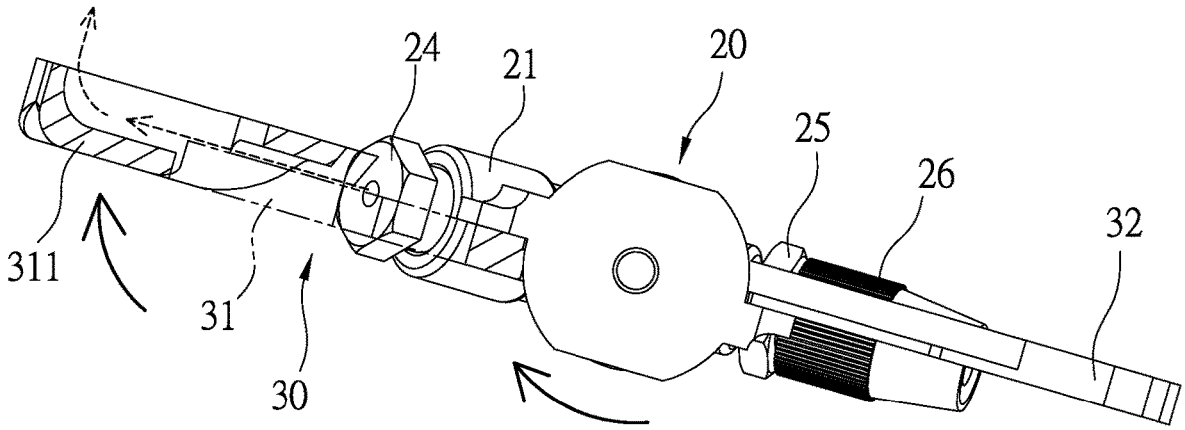
FIG. 11 is a schematic diagram showing the rotating member driving the output member to rotate during the sprinkling operation of the preferred embodiment according to the present invention.

Furthermore, as shown in FIGS. 9, 10, and 11, the first swing arm 31 of the rotating member 30 has a pushing portion 311 facing the first sprinkler 24. When the water flows is ejected from the first sprinkler 24 of the first outlet 21, it pushes the pushing part 311 to swing and move away from the first sprinkler 24, and then the scroll spring 27 pulls the first swing arm 31 to swing back and drive the output member 20 to swing and rotate around with the axial tube 12 on the top end of the base tube 11.

With the structure of the above specific embodiment, the following benefits can be obtained: the second sprinkler 25 of the output member 20 is a side water outlet and is used with an adjusting sleeve 26 in a screw combination, so that the second sprinkler 25 can be adjusted by rotating the adjusting sleeve 26, which improves the convenience of sprinkling operation without multiple sprinkler heads. Moreover, the output member 20 and the input base 10 are combined together to facilitate the replacement and maintenance of the output member 20 according to the different needs of sprinkling operations, so as to achieve a variety of sprinkling modes.

Although the present invention has been explained in relation to its preferred embodiment, it is to be understood that many other possible modifications and variations can be made without departing from the spirit and scope of invention as hereinafter claimed.

What is claimed is:

1. A garden sprinkler comprising:

an input base, a sprinkler assembly rotatably mounted on a top end of the input base, and a rotating member rotatably engaged with the sprinkler assembly;

wherein:

two sides of the sprinkler assembly respectively comprise a first outlet and a second outlet, the first and second outlets connected with a passage passing through an assembling portion of the sprinkler assembly, the assembling portion disposed at a bottom of the sprinkler assembly, the assembling portion coupling the sprinkler assembly with the top end of the input base;

the first outlet comprises a first sprinkler;

the second outlet comprises a second sprinkler and an adjusting sleeve;

the second sprinkler comprises a first section, a second section having an outer diameter smaller than an outer diameter of the first section, and an adjusting end, the first section comprising an outer threaded portion, the second section comprising an outlet aperture, the adjusting end having a T-shaped cross-section and protruding from a front end of the second section;

the adjusting sleeve is threadedly coupled with the first section of the second sprinkler;

an inner diameter of the adjusting sleeve is larger than the outer diameter of the second section to define a collecting space, and a spout is disposed at a front end of the adjusting sleeve, the spout and the collecting space connected by an output opening, and the output opening has an inner diameter larger than an outer diameter of the adjusting end;

wherein the input base comprises:

a base tube, an axial tube, and an elastic member;

wherein the base tube has a central axial aperture extending from a top end to a bottom end, and an external threaded section, and wherein the base tube further comprises an engaging section and an inserting section, the inserting section configured for being inserted into the elastic member and having a diameter smaller than a diameter of the engaging section, the engaging section and inserting section sequentially arranged from bottom to top of the base tube, and the threaded section is below the engaging section;

the axial tube is extends in the central axial aperture of the base tube and has a protruding lip with a groove at a bottom end pushing against the bottom end of the base tube, and a connecting portion with an outer threaded portion protruding from the inserting section of the base tube; and the second sprinkler further has an attaching portion with an outer threaded portion at one end, a head portion disposed between the attaching portion and the first section, and the head portion has a polygonal shape.

2. The garden sprinkler as claimed in claim 1, wherein the assembling portion of the sprinkler assembly internally has an inner threaded section engaging with the connecting portion of the axial tube, and the assembling portion pushes against the elastic member and maintains a gap from the base tube.

3. The garden sprinkler as claimed in claim 1, wherein the sprinkler assembly and the rotating member are connected to a scroll spring, the rotating member is positioned by a shaft bolt, the rotating member has a first swinging arm and a second swinging arm, and the scroll spring biases the first and second swinging arm with the first and second outlets, respectively.

4. The garden sprinkler as claimed in claim 1, wherein the adjusting sleeve further has an assembling portion with an inner threaded section engaging with the outer threaded portion of the first section of the second sprinkler, a ring groove is disposed between the assembling portion and the collecting space, and the ring groove comprises an O-ring pushing against the second section of the second sprinkler.

* * * * *